United States Patent [19]

Folk et al.

[11] 4,411,062

[45] Oct. 25, 1983

[54] APPARATUS AND METHOD FOR TERMINATING RIBBON CABLE

[75] Inventors: Kenneth F. Folk; Mark F. Jackson, both of Harrisburg, Pa.

[73] Assignee: AMP Incorporated, Harrisburg, Pa.

[21] Appl. No.: 227,016

[22] Filed: Jan. 21, 1981

[51] Int. Cl.[3] ..... H01R 43/04

[52] U.S. Cl. ..... 29/749; 29/753

[58] Field of Search ..... 29/748, 863, 861, 747, 29/749, 845, 857, 863, 751, 755, 760, 828

[56] References Cited

U.S. PATENT DOCUMENTS

| | | | |
|---|---|---|---|
| 3,953,925 | 5/1976 | Wilson . | |
| 4,017,954 | 4/1977 | Grubb | 29/749 |
| 4,043,034 | 8/1977 | Sucheski et al. | 29/747 |
| 4,068,912 | 1/1978 | Hudson et al. . | |
| 4,077,695 | 3/1978 | Bakermans . | |
| 4,125,137 | 11/1978 | Shatto, Jr. . | |
| 4,152,826 | 5/1979 | Mueller | 29/828 |
| 4,232,444 | 11/1980 | Bolick, Jr. | 29/863 |
| 4,351,110 | 9/1982 | Folk | 29/749 |

FOREIGN PATENT DOCUMENTS

| | | | |
|---|---|---|---|
| 7506800 | 12/1976 | Netherlands | 29/748 |

*Primary Examiner*—Howard N. Goldberg
*Assistant Examiner*—Carl J. Arbes
*Attorney, Agent, or Firm*—F. Brice Faller

[57] ABSTRACT

Apparatus for terminating ribbon cable to a two row connector having insulation displacing terminals facing opposite sides comprises a conductor programming station on a carriage, a connector positioning carriage, and a terminating station. The conductor programming station has combs which deflect individual conductors from the plane of the cable into channels in a pair of spaced apart templates which realign the conductors. The connector positioning carriage is slideable on a pair of rails to position a connector between the templates, and the two carriages are moved as a unit to the terminating station where the connector is positioned between a pair of insertion rams, which have tooling which passes through slots in the templates to terminate the conductors.

23 Claims, 13 Drawing Figures

APPARATUS AND METHOD FOR TERMINATING RIBBON CABLE

BACKGROUND OF THE INVENTION

This application is related to U.S. Pat. No. 4,351,110, which is hereby incorporated by reference.

The present invention relates generally to multiconductor terminating apparatus and particularly to apparatus for terminating ribbon cable to an electrical connector having two rows of terminals.

The advent of ribbon cable, which is now widely used in the electrical industry, has resulted in a variety of connectors and terminating apparatus adapted therefor. One approach has been to utilize connectors having two staggered rows of insulation displacing terminals spaced so that the terminals in one row will terminate alternate conductors in the cable, while the remaining conductors pass between those terminals and are terminated to the terminals in the other row. See, for example, U.S. Pat. No. 4,068,912. The connector is either applied to the cable by an apparatus as exemplified by U.S. Pat. No. 4,020,540, or the cable is applied to the connector by an apparatus as exemplified by U.S. Pat. No. 4,005,518. Connectors disclosed in the above cited patents generally comprise two or more parts which are engaged by the apparatus adapted therefor to achieve termination. For another example of connectors of this type see U.S. Pat. No. 3,820,055. The aforementioned are connectors of the type having two rows of terminals with mating ends opposite the cable terminating ends, the mating ends being mateable to pins or mating connectors by movement laterally of the axis of the ribbon cable.

A current generation of connectors utilizes two rows of terminals mateable by movement parallel to the axis of the ribbon cable. Wire terminating ends of one row of terminals face oppositely from wire terminating ends of the other row of terminals. For example, see U.S. Pat. No. 4,243,288, which is hereby incorporated by reference; this connector will be used to demonstrate the utility of the present invention in its preferred embodiment. As the center to center spacing of conductors in a ribbon cable is less than has been found practical for terminals in a connector, one approach to terminating ribbon cable to connectors of this type is to spread pre-split conductors by means of a template for termination to terminals in one side of the connector. See apparatus disclosed in U.S. Pat. No. 4,125,137. In order to terminate to both sides of the connector with an apparatus of this type, two cables would have to be terminated in separate operations.

Introduction of connectors of the type disclosed in U.S. Pat. No. 4,243,288 presented the need for an apparatus which could position the pre-split conductors of a ribbon cable into two planes and also position the conductors in each plane as necessary and in one operation terminate the conductors to insulation displacing terminals in opposite faces of the connector. U.S. Pat. No. 4,351,110 which is incorporated by reference, discloses an apparatus which performs these operations. This apparatus comprises a carriage mounted programming station, a conductor wiping probe, and a terminating station. The programming station comprises a pair of opposed comb members which cooperate with a pair of templates for initial wire positioning. The programming station is guided by a cam track to move in two directions relative to the stationary wiping probe and terminating station to achieve the desired position for termination.

SUMMARY

The present invention comprises a carriage mounted programming station, a carriage mounted wiping probe, and a termination station. The programming station comprises opposed comb members with integral templates for initial wire positioning. The wiping probe is carried on the end of a slide which is carried by the connector positioning carriage, and is movable into the programming station to wipe the conductors into the templates and to position the connector between the templates by movement in one direction only. The connector positioning carriage is locked into the programming station and the two are moved as a unit in the opposite direction into the terminating station where insertion tooling shears the ends off the individual conductors and terminates them to the connector in a single motion.

The present invention represents an advance over the invention disclosed in U.S. Pat. No. 4,351,110 insofar as tooling in the programming station has been simplified and the carriages move reciprocably in only one direction on a common axis, which eliminates the cam track and additional slide rails. Further, the movable probe and connector carriage combination permits loading of the connector remote from the terminating station, which presents the possibility of automatic loading by a magazine arrangement. This is also safer insofar as an operator's fingers need not be inserted in the terminating station when loading the connector into the apparatus. Another advantage of having the connector mobile relative to the terminating station is that connectors having terminals in excess of the number of inserters in the insertion tooling may be terminated by simply repositioning the programming station and connector carriage for an additional movement of the tooling.

These and other features of the present invention will be covered in detail in the description of the preferred embodiment with reference to the accompanying drawings.

DETAILED DESCRIPTION OF THE PREFERRED EMBODIMENT

Figure 1:
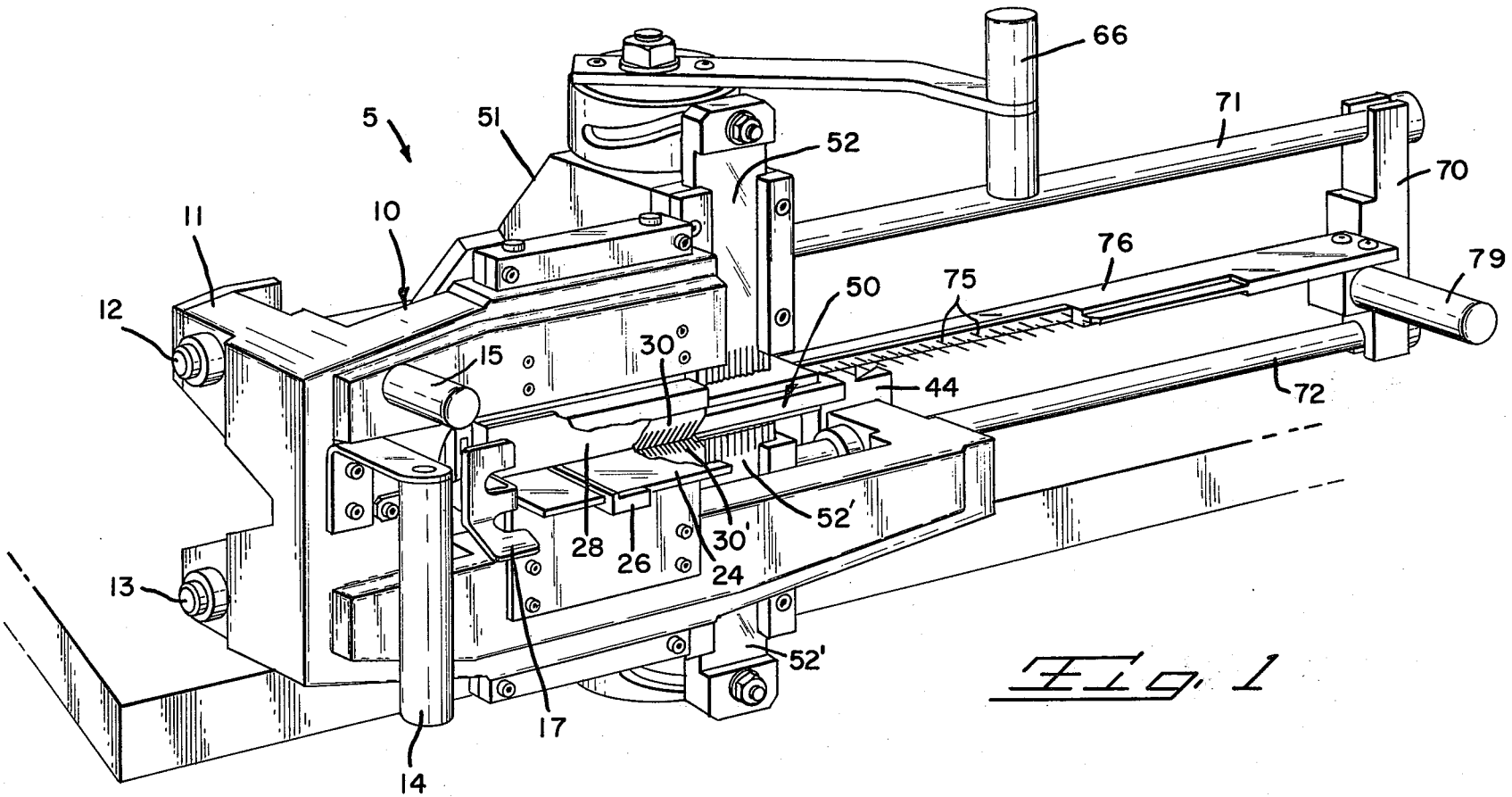
FIG. 1 is a perspective of the terminating apparatus.

FIG. 1 depicts the apparatus 5 of the present invention prior to any operations on a ribbon cable. Salient features are the programming station 10, terminating station 50, and connector positioning carriage 70. The terminating station 50 is located in a stationary frame 51 which carries upper and lower rails 12, 13 on one side and upper and lower rails 71, 72 on the other side. Upper rails 12, 71 are actually a single steel rod mounted through the frame 51 while lower rails 13, 72 are also a steel rod mounted through the frame 51 in parallel relationship to the upper rod. The programming station 10 consists of components mounted to a carriage 11 which is journaled to rails 12, 13 while the connector positioning carriage 70 is journaled to rails 71, 72.

In operation, a communications type ribbon cable is first split by a cable splitting device to separate the conductors at the end of the cable to be terminated. Such a device is disclosed in U.S. Pat. No. 4,230,008. Referring still to FIG. 1, the cable is then placed on platform 24 against cable guide 26 and slid under guard 28 where it is received between upper and lower combs 30, 30'. The conductors are then deflected in opposite directions at substantially right angles to the plane of the cable by flipping lever 47, which actuates tooling to be discussed in detail hereinafter. A connector of the type described in U.S. Pat. No. 4,243,288 is then placed on the connector positioning slide 76 and the carriage 70 to which the slide 76 is fixed is slid leftward by action on handle 79 until the connector is positioned in the programming station 10 as the connector positioning carriage 70 engages a carriage stop 44. The two carriages 11, 70 are then moved rightward as a unit by action on handle 44 until the connector is positioned at the termination station 50 where wire insertion is accomplished by swiveling handle 66 to the right. This causes upper insertion ram 52 to move downward while lower insertion ram 52' moves upward to insert the conductors into insulation displacing terminals in opposite sides of the connector. Handle 66 is then returned, the carriages 11, 70 are returned to leftward position, lever 17 is returned, the terminated cable is removed, and carriage 17 is returned to the right as shown in FIG. 1. The tooling used to accomplish the above operations will now be described in detail.

Figure 2A:
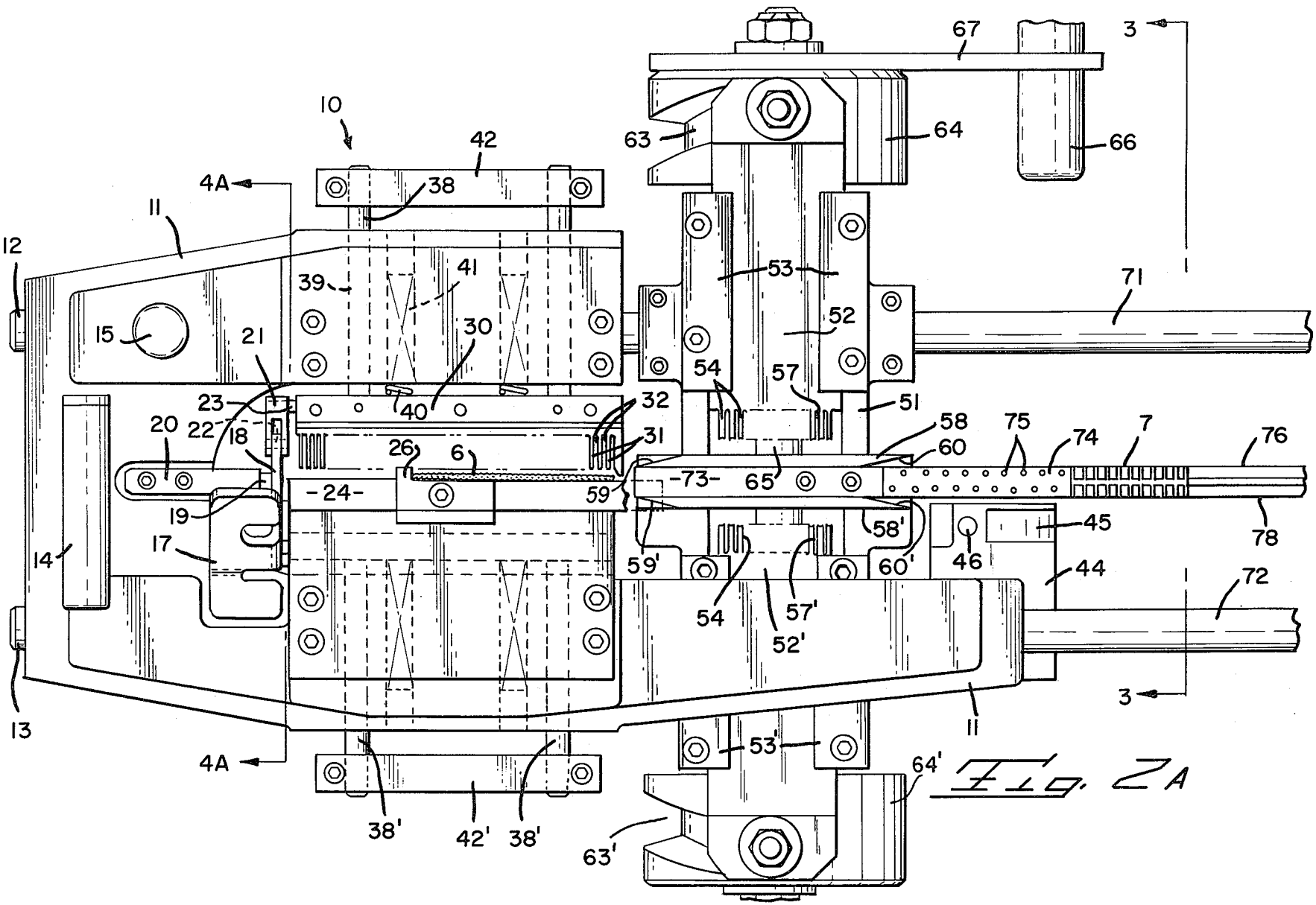
FIG. 2A is a front view of the apparatus with the comb members open prior to any operations on the cable.

FIG. 2A is a front view of the apparatus exclusive of connector carriage 70 after a cable 6 has been placed on the platform 24 and a connector 7 has been located on pins 75 in holding section 74 of slide 76. Referring first to programming station 10, upper comb member 30 having teeth 31 and spaces 32 therebetween is visible above platform 24. Guide shafts 38 pass through bores 39 in the carriage 11 and connect the comb member 30 to stop bar 42. The comb member 30 is spring loaded toward the cable by springs 40 in bores 41 in the carriage. A lower comb member 30', not visible in this view, is carried by similar components denoted by prime numbers corresponding to like components for the upper comb member. Toggle lever 17 is integral with toggle joint 18, which is pivotably mounted to frame 11 by pin 19 in bracket 20. The joint 18 is pivotably connected to upper toggle arm 21 at pin 22. Arm 21 is pivotably connected at its other end to comb member 30 by pin 23.

Referring still to FIG. 2A, components of terminating station 50 will be described. Upper and lower insertion rams 52, 52' are slideably carried in guide brackets 53, 53'. The rams 52, 52' each have crimpers 54, 54' machined in their facing ends which are separated by spaces 57, 57'. The rams have cam followers 62, 62' (not visible) bolted thereto at opposed ends which ride in cam tracks 63, 63' machined into barrels 64, 64' which are fixed to a common shaft 65 passing therebetween. The shaft 65 has a lever arm 67 fixed thereto at its upper end, with a handle 66 at the end of the lever arm. Swiveling the lever arm 67 by bearing on handle 66 causes the cam followers 62, 62' to ride in tracks 63, 63' which causes rams 52, 52' to move toward each other and pass immediately in front of stationary anvils 58, 58'. The anvils have facing parallel surfaces spaced apart sufficiently to accommodate the wiping probe 73 carried at the leftward end of the slide 76 which is fixed to connector carriage 70. This spacing is also just sufficient to accommodate the connector 7 which is carried by pins 75 in the holding section 74 of the slide 76. Note that the anvils 58, 58' having canted facing surfaces 60, 60' at the right end and canted opposing surfaces 59, 59' at the left end. Thus the connector can be readily slid through the anvils and into the programming station 10, at which point a spring loaded stop pin 80 (visible in FIG. 7) on the connector carriage 70 slides through sloped channel 45 in the carriage stop 44 and snaps into flared hole 46 to lock the two carriages relative to each other.

Figure 3:
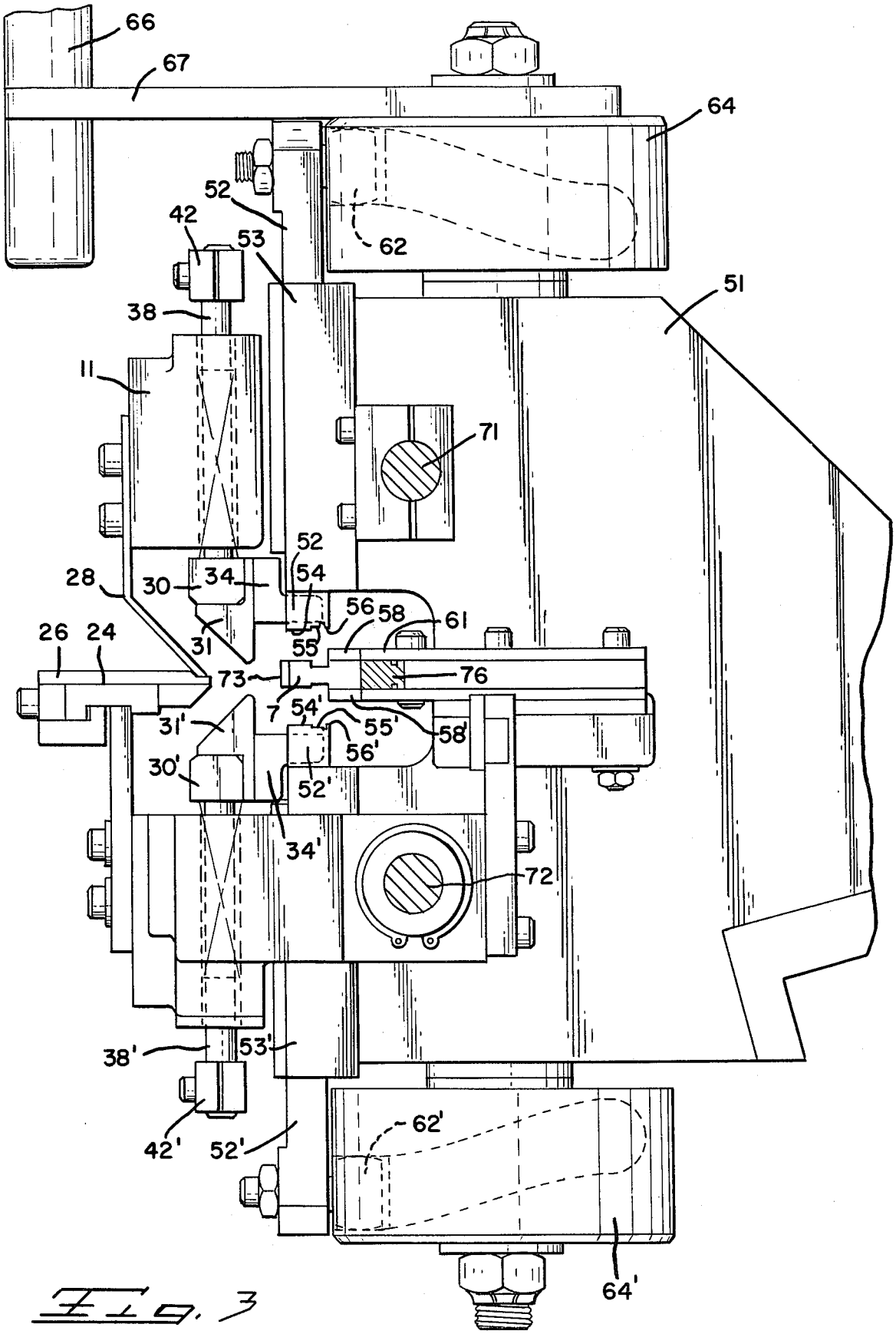
FIG. 3 is a side sectional view taken along line 3—3 of FIG. 2A.

FIG. 3 is another view of the apparatus in the position of FIG. 2A. The connector 7 is shown mated to the slide 76 between rams 52, 52'. Note that the rams are profiled with crimpers 54, 54' at the leading edges, wire inserters 55, 55' which are profiled to push the individual conductors into insulation displacing slots in individual terminals in the connector 7, and shears 56, 56' at the trailing edges which shear excess ends of the conductors against anvils 58, 58'. Combs 30, 30' appear in the open position prior to placing a cable on platform 24 and sliding it under guard 28, which is not shown in the front views for reasons of clarity.

Figure 2B:
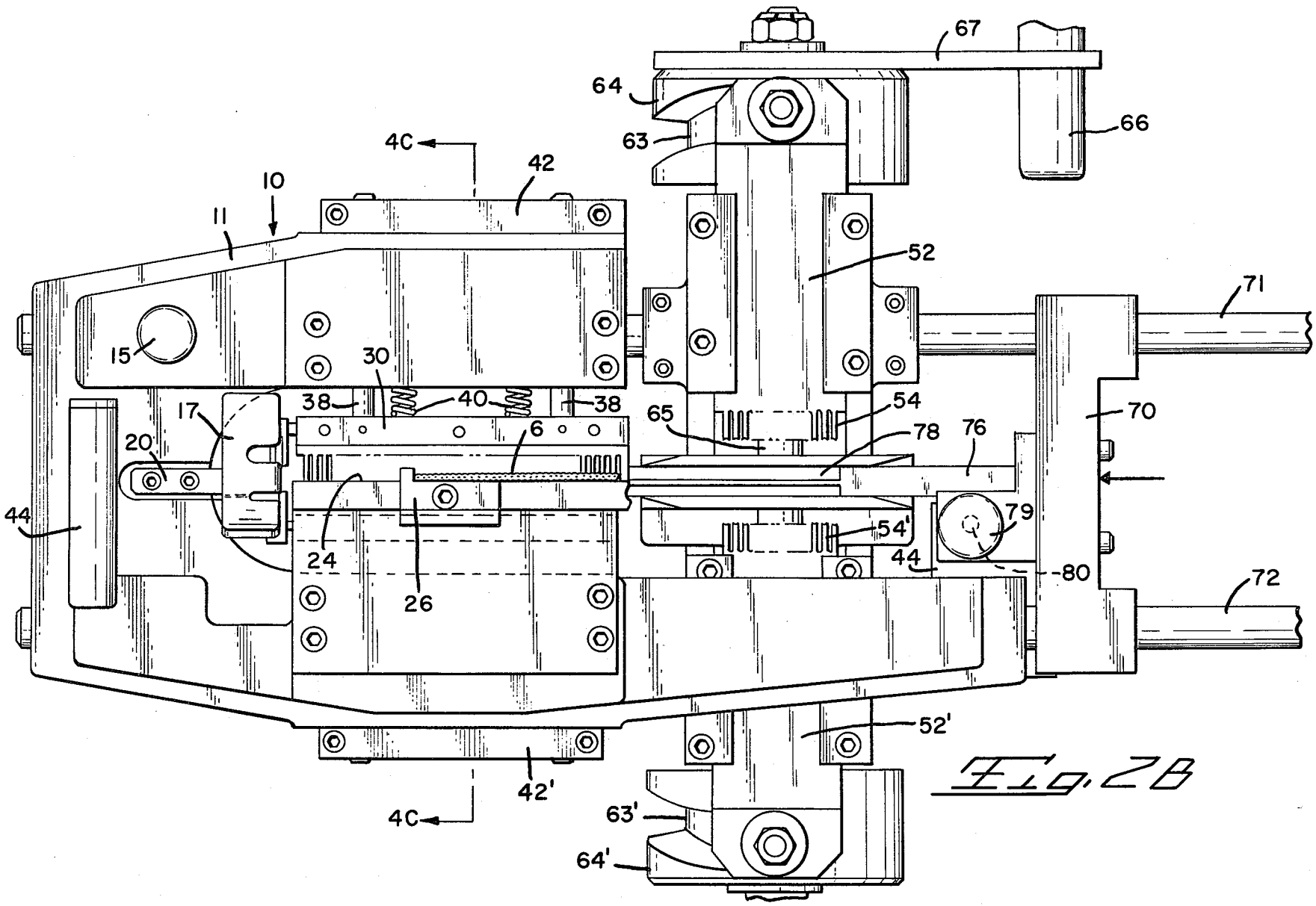
FIG. 2B is a front view subsequent to deflecting the conductors and positioning the connector.

FIG. 2B is a front view after the conductors in the cable have been programmed by flipping lever 17 upward and the connector carriage 70 has been locked relative to the programming carriage 11. Note that the upper comb member 30 has descended under the action of springs 40. Travel of the comb 30 was limited by the stop bar 42 adjustably clamped to the top of guide shafts. Cutaway section 78 of the slide 76 lies between the insertion rams 52, 52', so that if the rams are inadvertently actuated prior to positioning the connector therebetween no damage to crimpers 54, 54' will be incurred. Handle 79 on connector carriage 70 is over carriage stop 44 so that a spring loaded shaft 80 (FIG. 5) is in hole 46 (FIG. 2A) to lock the positioning carriage 70 to the programming carriage 11.

FIG. 2C is a front view immediately following termination of cable 6 to connector 7 (not visible). The insertion rams 52, 52' have been caused to move toward each other by turning handle 66 as shown which causes cam followers 62, 62' (FIG. 3) at opposed ends of rams 52, 52' to ride in cam tracks 63, 63' in barrels 64, 64' which are fixed to opposite ends of shaft 65 (FIGS. 2A, 2B). The rams are thus urged toward each other through guide brackets 53, 53' mounted to frame 51. The connector has been positively positioned relative to the rams by means of lock button 45, as will be apparent with reference to FIG. 5. Following termination, handle 66 is returned which causes the rams 53, 53' to move apart; the lock button 15 is pushed and the carriage 11 slid left; the toggle lever 17 is pushed down and so that the combs 30, 30' move apart; the lock button 79 is pulled so that carriage 70 can be returned to the right; and the connector and cable are removed.

Figure 2:
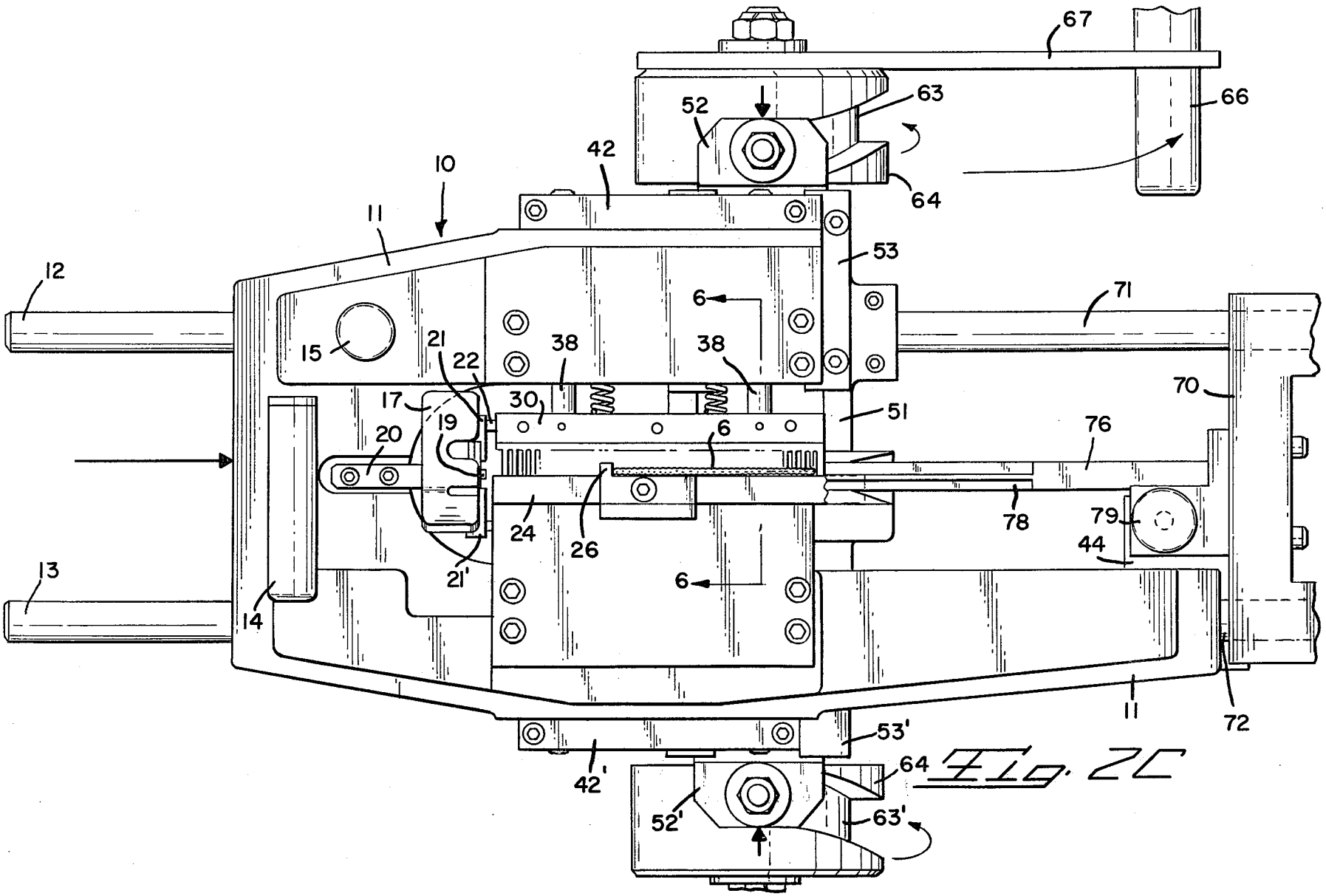
FIG. 2C is a front view subsequent to moving the programming station and connector carriage into the terminating station and terminating the conductors.
Figure 4A:
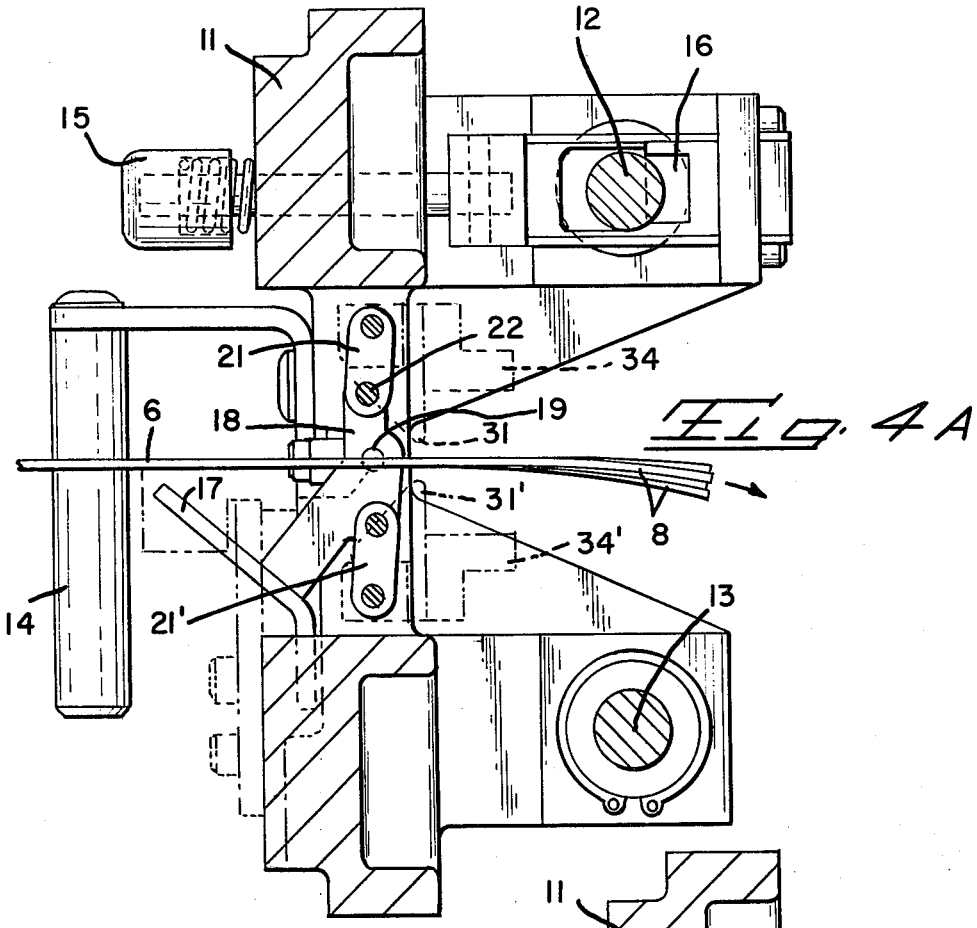
FIG. 4A is a side sectional view taken along line 4A—4A of FIG. 2A subsequent to cable insertion.
Figure 4B:
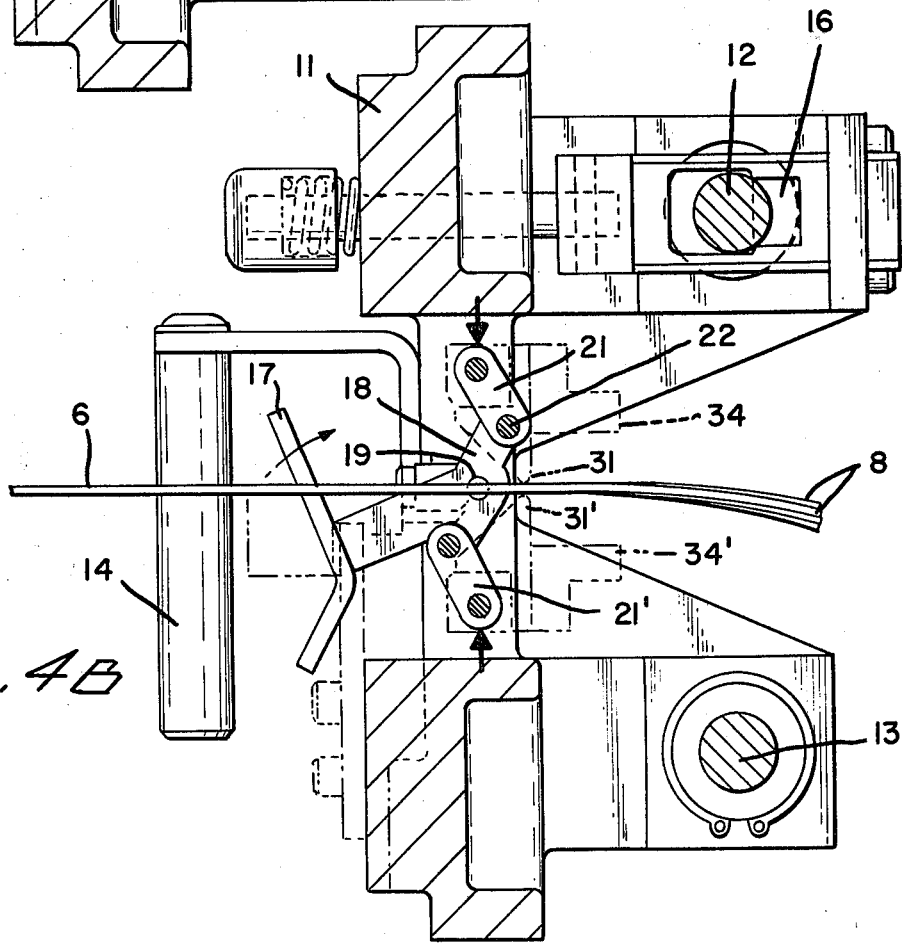
FIG. 4B is a side sectional view similar to FIG. 4A as the comb members bear against the cable.
Figure 4C:
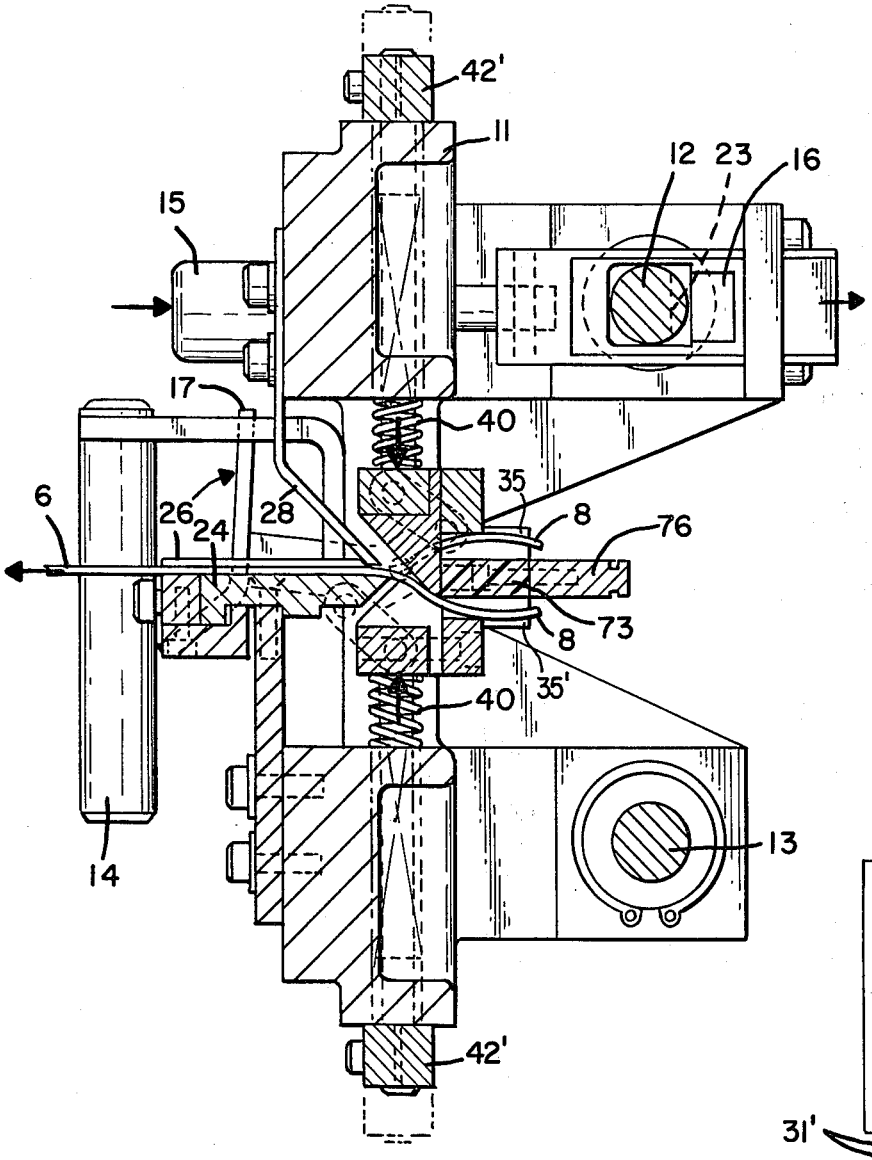
FIG. 4C is a side sectional view taken along line 4C—4C of FIG. 2B.

FIGS. 4A, 4B, and 4C detail the action of the combs 30, 30' and templates 34, 34' on the cable 6. FIG. 4A shows the toggle joint 18 locked in the open position by the upper and lower arms 21, 21' pivotably attached thereto, the arms being loaded slightly in a clockwise direction from the vertical by the action of springs 40, 40' (FIG. 2A). The cable is shown inserted such that a non-separated portion of cable 6 lies between teeth 31, 31' of the combs. Note spring loaded lock button 15 which holds wedge 16 in a notch in rail 12 so that carriage 11 remains stationary relative to the rails 12, 13. FIG. 4B shows the teeth 31, 31' loaded against the non-separated portion of cable 6. Toggle lever 17, which is integral with toggle joint 18, has been moved manually, causing arms 21, 21' to rotate counterclockwise from the locked position, thus causing teeth 31, 31' to bear on the cable under the action of the springs 40, 40' (FIG. 2).

FIG. 4C shows the combs after the cable has been pulled to the left therebetween so that the teeth 31, 31' deflect adjacent conductors 8 in opposite directions under the action of springs 40, 40'. Note that the wire guide 26 must be carefully positioned and the cable 6 positioned thereagainst during the programming operation to assure that each tooth 31, 31' bears against a single conductor. As the teeth 31 move as far as possible into spaces 32' between teeth 31' and teeth 31' move as far as possible into spaces 32 between teeth 31, the individual conductors are deflected into channels 35, 35' in templates 34, 34'. The probe 73 is then slid between the templates 34, 34' to ensure that the conductors 8 are within the channels 35, 35' as shown. Since the probe is profiled as the connector, the connector is thus readily positioned between the templates.

Note that for connectors having a different profile, a probe and templates having a corresponding profile would be utilized. The probe 73 (FIG. 7) is preferably plastic piece to mitigate against conductor damage if one should happen to hang up between the templates, although the shape of the probe 73 (FIG. 7) is directed to guiding any stray conductors into the channels 35, 35' in the templates. The plastic further precludes damage to the crimpers 54, 54' as well as inserters 55, 55' and shears 56, 56' should the rams 52, 52' inadvertently be brought to bear against the probe 73. The probe is bolted to slide 76 which is profiled to ride through a slide track 61 fixed in frame 51 adjacent to the anvils 58, 58' (FIG. 3). Note also in FIG. 4C that the operation of lock button 15 is demonstrated. Depression of the button 15 as shown causes wedge 16 to remove from a notch 23 in rail 12 so that the carriage 11 can be moved relative thereto.

Figure 8:
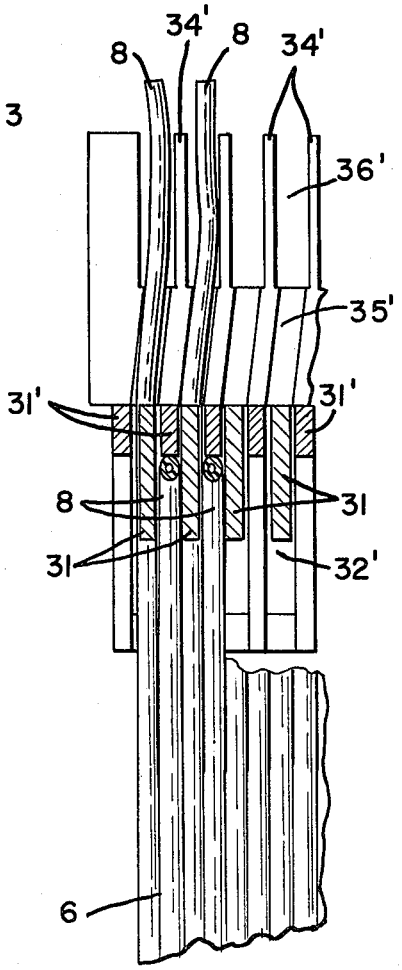
FIG. 8 is a section view of comb members and templates taken along line 8—8 of FIG. 6A.

Referring to FIG. 8, the function of the templates will be more readily apparent. Spaces 32' between teeth 31' are contiguous with channels 35' in the template. Upper comb teeth 31 are shown in section as they penetrate spaces 32' and bear on alternate conductors 8 to push them into channels 35' over slots 36'. The templates have slots 36' therethrough which are contiguous with the channels 35' opposite from the spaces 32'. The slots are profiled to receive the crimpers 54' as well as adjacent inserters 55' and shears 56' which pass therethrough during termination of conductors 8 to connector 7. An important feature of the templates, is that each channel 35' shifts the conductor therein laterally by half the width of the conductor between the space 32' and the slot 36'. The channels 35 in upper template 30 shift each conductor laterally one half a conductor width in the opposite direction. Thus, conductors which are adjacent in the cable are programmed into the same vetical plane as the slots, so that they can be terminated to directly opposed terminals in the connector. The net effect is that a ribbon cable or other planar array of conductors may be terminated to a connector of the same width as the cable or array, where the connector is a two sided one having terminals which each require twice the width of an individual conductor for termination.

Figures 5, 7:
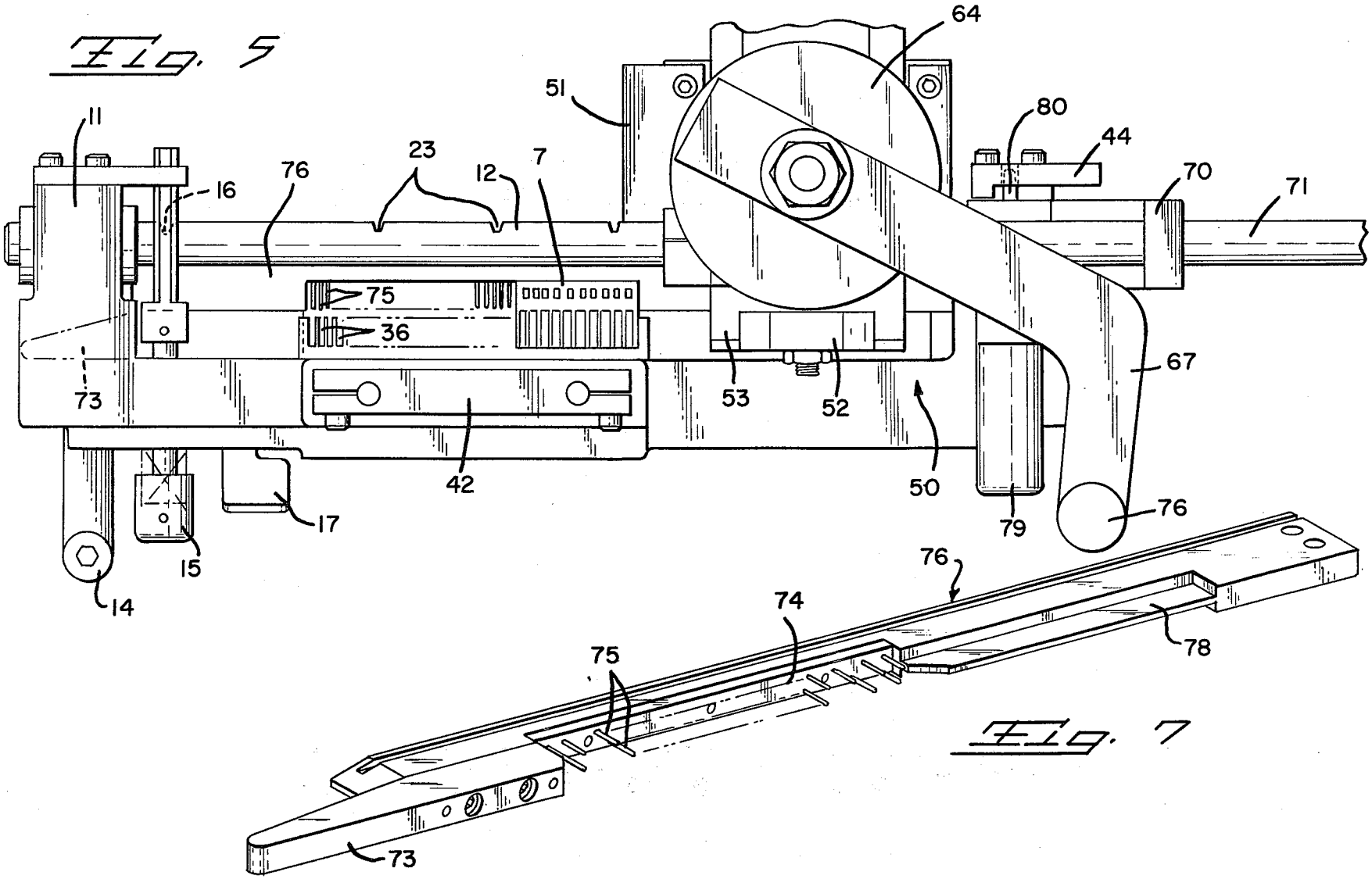
FIG. 5 is a top view corresponding to FIG. 2C.
FIG. 7 is a perspective of the connector positioning carriage.

FIG. 5 is a top view corresponding to FIG. 2C, showing the connector positioning carriage 70 as locked to the programming carriage 11 by the action of the shaft 80 in carriage stop 44. The several notches 23 in rail 12 are also apparent; these allow the programming carriage 11 to be locked in a number of positions relative to the terminating station 50. Thus, where the size of the connector exceeds the size of the insertion rams, the connector may be repositioned relative to the rams for additional insertion operations. For example, the preferred embodiment shows rams each having twelve crimping jaws, which permits terminating a twenty-four terminal connector in a single motion of the rams. The connector carriage, however, can accommodate a seventy-two terminal connector. Terminating such a connector to a 72-conductor cable would necessitate positioning the terminal three times with respect to the rams by pushing button 15 and locking the carriage 11 to a different notch in rail 12. After each termination the lever arm 67 is rotated back to the position shown so that the connector can be repositioned.

Figure 6A:
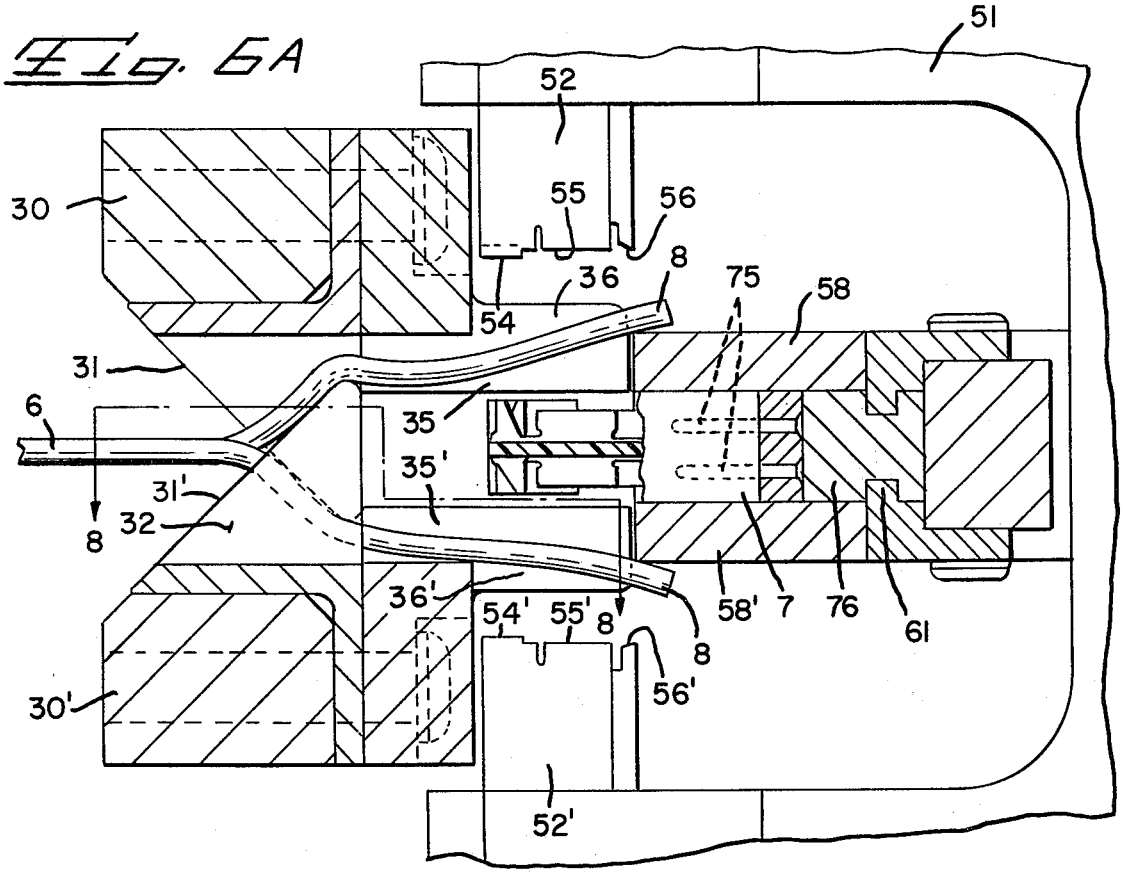
FIG. 6A is a section view taken along line 6—6 of FIG. 2C before the insertion rams move toward the connector.
Figure 6B:
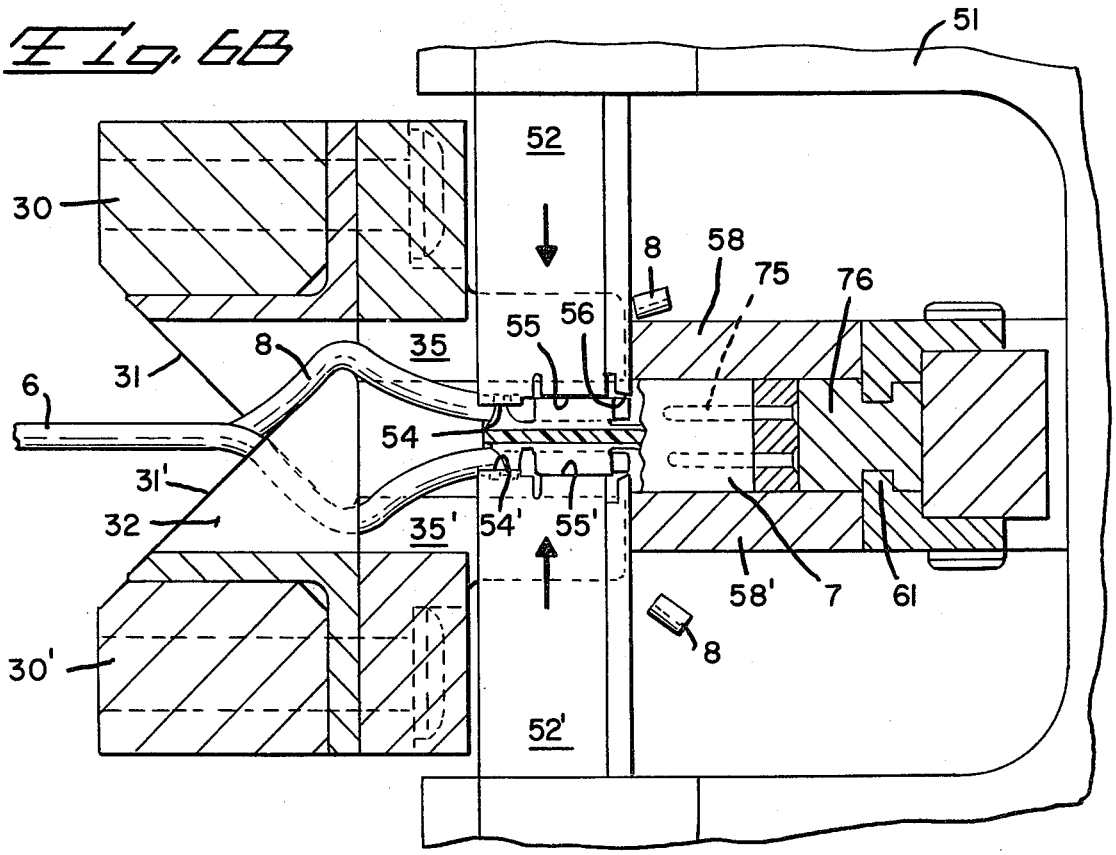
FIG. 6B is a section view similar to FIG. 6A, subsequent to wire insertion.

FIGS. 6A and 6B show the detail of the terminating station 50. FIG. 6A shows the conductors 8 as programmed into the channels 35, 35' and slots 36, 36'. Each slot 36 is a continuation of the channel 35, being distinguished only by passing through the template 34 so that the crimpers 54 may pass through as shown in FIG. 6B. Note that crimpers 54, 54' crimp the strain relief portion of each terminal to the insulation on the conductor while the inserters 55, 55' push the conductors into the insulation displacing portion where contact is made. Here reference to U.S. Pat. No. 4,243,288 for the connector 7 would be helpful. The conductors are trimmed by shears 56, 56' against anvils 58, 58' as shown. Note that the slide 76 is profiled to fit closely in slide track 61 to ensure smooth carriage travel and precise positioning. Pins 75 protruding from the holding section 74 on slide 76 are shown with sockets of the connector 7 mated thereto.

FIG. 7 details the connector positioning slide 76 in perspective. Pins 75 are each sized to snugly fit into a mating socket in the connector, which is pushed firmly onto the pins to position it in the slide. The probe 73 is profiled to pass between the templates and the slide 76 is profiled to pass between the anvils.

The foregoing description is illustrative and not intended to limit the scope of the claims which follow.

What is claimed is:

1. An apparatus for terminating the separated conductors at the free end of a ribbon cable to terminals in opposite sides of a connector, said apparatus comprising:

a conductor programming station having means for deflecting adjacent conductors of said cable in opposite directions from the plane of the cable, alternate conductors being deflected in the same direction, said conductor programming station lying on a linear path;

connector positioning means movable on said linear path relative to said programming station, said positioning means having means for holding said connector and positioning said connector between said oppositely deflected conductors subsequent to deflection at said programming station;

a terminating station movable on said linear path relative to said programming station and said connector positioning means, said terminating station being located between first and second insertions rams having means for terminating said conductors to said terminals in said connector while said connector is positioned between said oppositely deflected conductors.

2. The apparatus of claim 1 which further comprises means for fixing said positioning means relative to said programming station subsequent to positioning said connector between said deflected conductors, whereby, said connector and conductors may readily be moved as a unit relatively toward said termination station.

3. The apparatus of claim 2 which further comprises means for fixing said programming station relative to said terminating station, whereby said connector and conductors may readily be positioned for termination at said terminating station.

4. The apparatus of claim 3 wherein said means for fixing said programming station relative to said terminating station is adapted to fix said programming station relative to said terminating station in several positions, whereby several terminating operations may be performed on a single connector.

5. The apparatus of claim 1 wherein said programming station comprises:

opposed first and second comb members having teeth and spaces therebetween, said comb members being movable toward each other, the teeth of the first comb member being adapted to bear on alternate conductors at the free end of the ribbon cable and to push them into the spaces between the teeth of the second comb member, the teeth of the second comb member being adapted to bear on alternate conductors adjacent those borne against by the teeth of the first comb member and to push them into the spaces between the teeth of the first comb member.

6. The apparatus of claim 5 wherein said programming station further comprises:

first and second templates integral with respective first and second comb members, each said template having channels therein, said channels in said first template being contiguous with said spaces in said first comb member, said channels in said second template being contiguous with said spaces in said second comb member, whereby, upon placing said free end of said ribbon cable between said comb members and moving said comb members toward each other, said conductors will be deflected into the spaces between said teeth and into said channels in said templates.

7. The apparatus of claim 5 wherein said comb members are spring loaded toward each other, whereby said ribbon cable may be placed between said comb members and said teeth may be brought to bear against said cable resiliently at a point remote from said free end where said conductors are not separated, and upon drawing said cable between said comb members said teeth will automatically deflect said conductors in opposite directions as the separated conductors at the free end are borne against by said teeth.

8. The apparatus of claim 6 wherein said connector positioning means comprises a wiping fixture adapted to pass between said oppositely deflected conductors ahead of said connector when said comb members are moved fully toward each other, said wiping fixture being shaped to ensure that said conductors are deflected fully into the channels in said templates, whereby a connector profiled as said templates may be positioned therebetween by sliding said positioning means holding a connector between said templates.

9. The apparatus of claim 6 wherein said terminating means comprises individual inserters sized to enter said channels in respective templates, said channels being contiguous with slots through said templates where said inserters enter, said inserters being movable toward each other and through said slots when said programming station and connector positioning means are positioned at said terminating station, whereby, a connector may be terminated by placing a ribbon cable in said programming station and bringing said comb members to bear on said separated conductors in the free end of the cable, positioning a connector between said deflected conductors, moving said programming station and positioning means to said terminating station so that said connector lies between said insertion rams with said conductors and terminals aligned with the inserters, and moving the rams toward each other so that the inserters pass through said slots and force the conductors into the terminals.

10. The apparatus of claim 9 wherein said apparatus station further comprises opposed first and second shears integral with respective first and second insertion rams, said positioning means further comprising opposed anvils adjacent to where said connector is held and cooperable with said shears, whereby said conductors may be trimmed as said insertion rams are moved toward each other.

11. The apparatus of claim 1 wherein said terminating station is located in a stationary frame, said connector positioning means being journaled to a first rail on one side of the terminating station, said conductor programming station being journaled to a second rail on the opposie side of said terminating station, said first and second rails having parallel axes.

12. An apparatus for terminating the separated conductors at the free end of a ribbon cable to terminals in opposite sides of a connector, said apparatus being of the type comprising a conductor programming station lying on a linear path and having means for deflecting adjacent conductors of said cable in opposite directions from the plane of the cable while deflecting alternate conductors in one direction, connector positioning means movable on said linear path movable relative to said programming station said positioning means having means for holding said connector and positioning said connector between said oppositely deflected conductors subsequent to deflection at said programming station, and further comprising a terminating station movable on said linear path relative to said programming station, said terminating station being located between opposed first and second insertion rams having means for terminating said conductors to said terminals in said connector while said connector is positioned between said oppositely deflected conductors, characterized in that said terminating station is movable relative to said connector positioning means.

13. The apparatus of claim 12 characterized in that it further comprises means for fixing said positioning means relative to said programming station subsequent to positioning said connector between said deflected conductors whereby said connector and conductors may readily be moved as a unit relatively toward said termination station.

14. The apparatus of claim 13 characterized in that it further comprises means for fixing said programming station relative to said terminating station whereby said connector and conductors may readily be positioned for termination at said terminating station.

15. The apparatus of claim 14 characterized in that said means for fixing said programming station relative to said terminating station is adapted to fix said programming station relative to said terminating station in several positions, whereby several terminating operations may be performed on a single connector.

16. The apparatus of claim 12 characterized in that said programming station comprises opposed first and second comb members having teeth and spaces therebetween, said comb members being movable toward each other, the teeth of the first comb member being adapted to bear on alternate conductors at the free end of the ribbon cable and to push them into the spaces between the teeth of the second comb member, the teeth of the second comb member being adapted to bear on alternate conductors adjacent those borne against by the teeth of the first comb member and to push them into the spaces between the teeth of the first comb member.

17. The apparatus of claim 16 characterized in that said programming station further comprises first and second templates integral with respective first and second comb members each said template having channels therein, said channels in said first template being contiguous with said spaces in said first comb member, said channels in said second template being contiguous with said spaces in said second comb member, whereby, upon placing said free end of said ribbon cable between said comb members and moving said comb members toward each other, said conductors will be deflected into the spaces between said teeth and into said channels in said templates.

18. The apparatus of claim 16 characterized in that said comb members are spring loaded toward each other, whereby said ribbon cable may be placed between said comb members and said teeth may be brought to bear against said cable resiliently at a point remote from said free end where said conductors are not separated, and upon drawing said cable between said comb members, said teeth will automatically deflect said conductors in opposite directions as the separated conductors at the free end are borne against by said teeth.

19. The apparatus of claim 17 characterized in that said connector positioning means comprises a wiping fixture adapted to pass between said oppositely deflected conductors ahead of said connector when said comb members are moved fully toward each other, said wiping fixture being shaped to ensure that said conductors are deflected fully into the channels in said templates, whereby a connector profiled as said templates may be positioned therebetween by sliding said positioning means holding a connector between said templates.

20. The apparatus of claim 17 characterized in that said terminating means comprises individual inserters sized to enter said channels in respective templates, said channels being contiguous with slots through said templates where said inserters enter, said inserters being movable toward each other and through said slots when said programming station and connector positioning means are positioned at said terminating station, whereby a connector may be terminated by placing a ribbon cable in said programming station and bringing said comb members to bear on said separated conductors in the free end of the cable, positioning a connector between said deflected conductors, moving said programming station and positioning means to said terminating station so that said connector lies between said insertion rams with said conductors and terminals aligned with the inserters and moving the rams toward each other so that the inserters pass through said slots and force the conductors into the terminals.

21. The apparatus of claim 20 characterized in that said apparatus further comprises opposed first and second shears integral with respective first and second insertion rams, said positioning means further comprising opposed anvils adjacent to where said connector is held and cooperable with said shears, whereby said conductors may be trimmed as said insertion rams are moved toward each other.

22. The apparatus of claim 17 characterized in that said channels in said first template laterally deflect said alternate conductors one-half the center-to-center distance between adjacent conductors, said channels in said second template deflecting the remaining conductors the same distance in the opposite direction, whereby said adjacent conductors may be aligned in the same vertical plane with directly opposed terminals in the connector.

23. The apparatus of claim 12 characterized in that said terminating station is located in a stationary frame, said connector positioning means being journaled to a first rail on one side of the terminating station, said conductor programming station being journaled to a second rail on the opposite side of said terminating station, said first and second rails having parallel axes.

* * * * *